US010630025B2

(12) United States Patent
Ikeya et al.

(10) Patent No.: US 10,630,025 B2
(45) Date of Patent: Apr. 21, 2020

(54) LEVER TYPE CONNECTOR THAT PREVENTS THE PIVOT OF THE LEVER FROM BEING INCLINED

(71) Applicant: Yazaki Corporation, Minato-ku, Tokyo (JP)

(72) Inventors: Kazuhide Ikeya, Makinohara (JP); Kenji Kajikawa, Fujieda (JP); Takuro Hosozawa, Fujieda (JP); Yoshihito Masuko, Fujieda (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/903,614

(22) Filed: Feb. 23, 2018

(65) Prior Publication Data

US 2018/0316135 A1 Nov. 1, 2018

(30) Foreign Application Priority Data

Apr. 27, 2017 (JP) ..... 2017-088264

(51) Int. Cl.
*H01R 13/629* (2006.01)

(52) U.S. Cl.
CPC . *H01R 13/62994* (2013.01); *H01R 13/62938* (2013.01); *H01R 13/62955* (2013.01)

(58) Field of Classification Search
CPC ..... H01R 13/62933; H01R 13/62938; H01R 13/62955; H01R 13/62994
USPC ..... 439/157, 153, 372
See application file for complete search history.

(56) References Cited

U.S. PATENT DOCUMENTS 6,183,277 B1 2/2001 Okabe et al.
6,602,082 B2 * 8/2003 Nishide ..... H01R 13/62938 439/157
6,705,882 B2 * 3/2004 Casses ..... H01R 13/62933 439/153
7,214,078 B2 * 5/2007 Fukatsu ..... H01R 13/62938 439/157
7,241,156 B1 * 7/2007 Margrave ..... H01R 13/62938 439/157
7,419,390 B2 * 9/2008 Ohtaka ..... H01R 13/639 439/157

(Continued)

FOREIGN PATENT DOCUMENTS

JP 2000091026 A 3/2000
JP 2009009876 A 1/2009

(Continued)

OTHER PUBLICATIONS

May 7, 2019—(JP) Notice of Reasons for Refusal—App 2017-088264, Eng Tran.

*Primary Examiner* — Travis S Chambers
(74) *Attorney, Agent, or Firm* — Banner & Witcoff, Ltd.

(57) ABSTRACT

A lever type connector includes a housing configured to fit to a mating connector and a lever mounted on the housing and configured to draw the mating connector and the housing closer to each other when the lever moves from a temporary locking position to a final locking position. The lever includes a temporary locking arm which is elastically deformable in a direction away from a surface of the housing, and rotates between the temporary locking position and the final locking position while the temporary locking arm comes into press-contact with a sliding surface which is part of the surface of the housing.

7 Claims, 8 Drawing Sheets

(56) References Cited

U.S. PATENT DOCUMENTS

| | | | | |
|---|---|---|---|---|
| 7,445,474 | B2 * | 11/2008 | Sakatani | H01R 13/62938 439/157 |
| 7,811,104 | B2 * | 10/2010 | Matsumura | H01R 13/62955 439/157 |
| 8,011,938 | B2 * | 9/2011 | Martin | H01R 13/62922 439/157 |
| 2007/0298637 | A1 * | 12/2007 | Matsuura | H01R 13/62955 439/157 |
| 2009/0269966 | A1 | 10/2009 | Takahashi et al. | |
| 2014/0248788 | A1 * | 9/2014 | Kodama | H01R 13/62938 439/310 |
| 2016/0141798 | A1 | 5/2016 | Kawashima | |

FOREIGN PATENT DOCUMENTS

| | | | |
|---|---|---|---|
| JP | 2009-117059 | A | 5/2009 |
| JP | 2016096107 | A | 5/2016 |

* cited by examiner

LEVER TYPE CONNECTOR THAT PREVENTS THE PIVOT OF THE LEVER FROM BEING INCLINED

CROSS REFERENCE TO RELATED APPLICATIONS

This application is based on Japanese Patent Application (No. 2017-088264) filed on Apr. 27, 2017, the contents of which are incorporated herein by reference.

BACKGROUND OF THE INVENTION

1. Field of the Invention

The present invention relates to a lever type connector which includes a housing configured to fit to a mating connector and a lever mounted on the housing.

2. Description of the Related Art

In the related art, a lever type connector is proposed which includes a lever to support fitting between a male housing and a female housing. For example, in one of the lever type connectors in the related art, the lever is rotatably mounted in one housing and a projecting pin is provided in the other housing. Then, when the lever is rotated in a state where the projecting pin is inserted into a cam hole of the lever, both housings are drawn to be close to each other and to be fitted (for example, see JP-A-2009-117059).

In general, when the lever type connector described above is used, an operator brings a terminal (for example, a male terminal) stored in the housing into contact with a terminal (for example, a female terminal) stored in the other housing while fitting the housings by rotating the lever. At this time, when a pivot of the lever is inclined, the operator cannot fit the housings as designed, and thus the contact of these terminals may be insufficient.

For example, in a case where the lever type connector is disposed at a position where the operator hardly views (for example, a position inside a vehicle), it is hard for the operator to apply a force on the lever in an appropriate direction, and the pivot of the lever may be inclined. Such an inclination of the pivot of the lever is desirably avoided as much as possible.

SUMMARY OF THE INVENTION

The invention has been made in view of the above problems, and an object thereof is to provide a lever type connector which can prevent the pivot of the lever from being inclined.

To achieve the above object, there is provided a lever type connector as follows.

(1) There is provided a lever type connector, comprising:

a housing configured to fit to a mating connector; and a lever mounted on the housing and configured to draw the mating connector and the housing to be close to each other when the lever moves from a temporary locking position to a final locking position, wherein the lever comprises a temporary locking arm which is elastically deformable in a direction away from a surface of the housing, and rotates between the temporary locking position and the final locking position while the temporary locking arm comes into press-contact with a sliding surface which is a part of the surface of the housing.

(2) For example, the housing further comprises a cover configured to cover the sliding surface, and the cover comprises a depressed portion in an inner wall surface facing the sliding surface such that the temporary locking arm is configured to pass through a space between the sliding surface and the cover.

(3) For example, the housing has a symmetric structure in which the lever is mountable to the housing in a reversible manner with respect to a width direction of the housing, the housing comprises an identifying hollow which is opened to an outside and a fitting hollow configured to receive the mating connector, an identifying portion corresponding to each mounting direction of the lever is provided in an inner portion of the identifying hollow, and the identifying hollow is different in position from the fitting hollow.

(4) For example, the identifying portion is provided near an opening end of the identifying hollow.

(5) For example, the housing includes a first sliding surface which corresponds to a first mounting direction of the lever, and a second sliding surface which corresponds to a second mounting direction of the lever, the lever is configured that when the lever is mounted in the first mounting direction, the temporary locking arm comes into press-contact with the first sliding surface, and an edge of the lever is positioned on the second sliding surface, and the lever is configured that when the lever is mounted in the second mounting direction, the temporary locking arm comes into press-contact with the second sliding surface, and an edge of the lever is positioned on the first sliding surface.

(6) For example, the direction away from the surface of the housing is substantially same as an axis direction of a rotation axis of the lever rotating between the temporary locking position and the final locking position.

According to the lever type connector of the configuration (1), when the lever rotates between the temporary locking position and the final locking position, the temporary locking arm comes into press-contact with the sliding surface all the time. Conversely, an elastically deforming force (hereinafter, referred to as "elastic force") of the temporary locking arm is applied from the sliding surface to the temporary locking arm (also the lever). Even if the pivot of the lever is inclined due to the elastic force while the lever is rotating, the pivot of the lever naturally returns to the original posture. Therefore, the lever type connector of this configuration can prevent the inclination of the pivot of the lever compared to a case where the temporary locking arm dose not come into press-contact with the sliding surface.

According to the lever type connector of the configuration (2), the temporary locking arm rotates between the temporary locking position and the final locking position in a state where the housing is covered with a cover. Therefore, the rotation of the temporary locking arm is not hindered by peripheral members. Further, contamination of foreign matter is prevented between the temporary locking arm and the sliding surface. In addition, the cover also contributes to improvement of the outer appearance of the lever type connector.

According to the lever type connector of the configuration (3), even in a case where the housing has a symmetric structure in which the lever can be mounted in a reversible manner with respect to a width direction (so-called a reversible housing), the mounting direction of the lever can be confirmed with reference to an identifying portion, so that it is possible to prevent that the lever is mounted in an erroneous direction. For example, if the disposition of the identifying portion provided in the identifying hollow and the presence/absence of the identifying portion are recognized optically and mechanically, the mounting direction of the lever can be confirmed without relying on human eyes.

Further, since the identifying portion is provided in the hollow different from the fitting hollow, the identifying portion does not affect the fitting between the connectors. In other words, a request that only the mounting direction of the lever is switched while keeping the structure of the fitting hollow is satisfied. In addition, since the identifying portion is provided in the identifying hollow, a problem that the identifying portion comes into contact with a wire extending from the connector is prevented. Further, since the identifying portion is provided without changing a mold of the fitting hollow, it is possible to prevent an increase in manufacturing cost of the lever type connector.

According to the lever type connector of the configuration (4), since the identifying portion is near the opening end of the identifying hollow, it is possible to easily recognize the disposition of the identifying portion and the presence/absence of the identifying portion compared to a case where the identifying portion is deep inside the identifying hollow.

According to the lever type connector of the configuration (5), the posture of the lever can be held by both of the temporary locking arm and the edge of the lever in both cases where the lever is mounted in the mounting direction and in the other mounting direction. Specifically, when the pivot of the lever is inclined, the pivot of the lever naturally returns to the original posture by the elastic force caused by the temporary locking arm and the reaction force generated when the edge of the lever comes into contact with the sliding surface. Therefore, the lever type connector of this configuration can more surely prevent that the pivot of the lever is inclined.

According to the invention, it is possible to provide a lever type connector which can prevent an inclination of a pivot of a lever.

Hereinbefore, the invention has been simply described. Further, the details of the invention will be clearer through the following explanation of modes (hereinafter, referred to as "embodiment") for carrying out the invention described below with reference to the accompany drawings.

DETAILED DESCRIPTION OF THE EXEMPLARY EMBODIMENTS

Embodiment

Hereinafter, a lever type connector according to an embodiment of the invention will be described with reference to the drawings.

Figure 1:
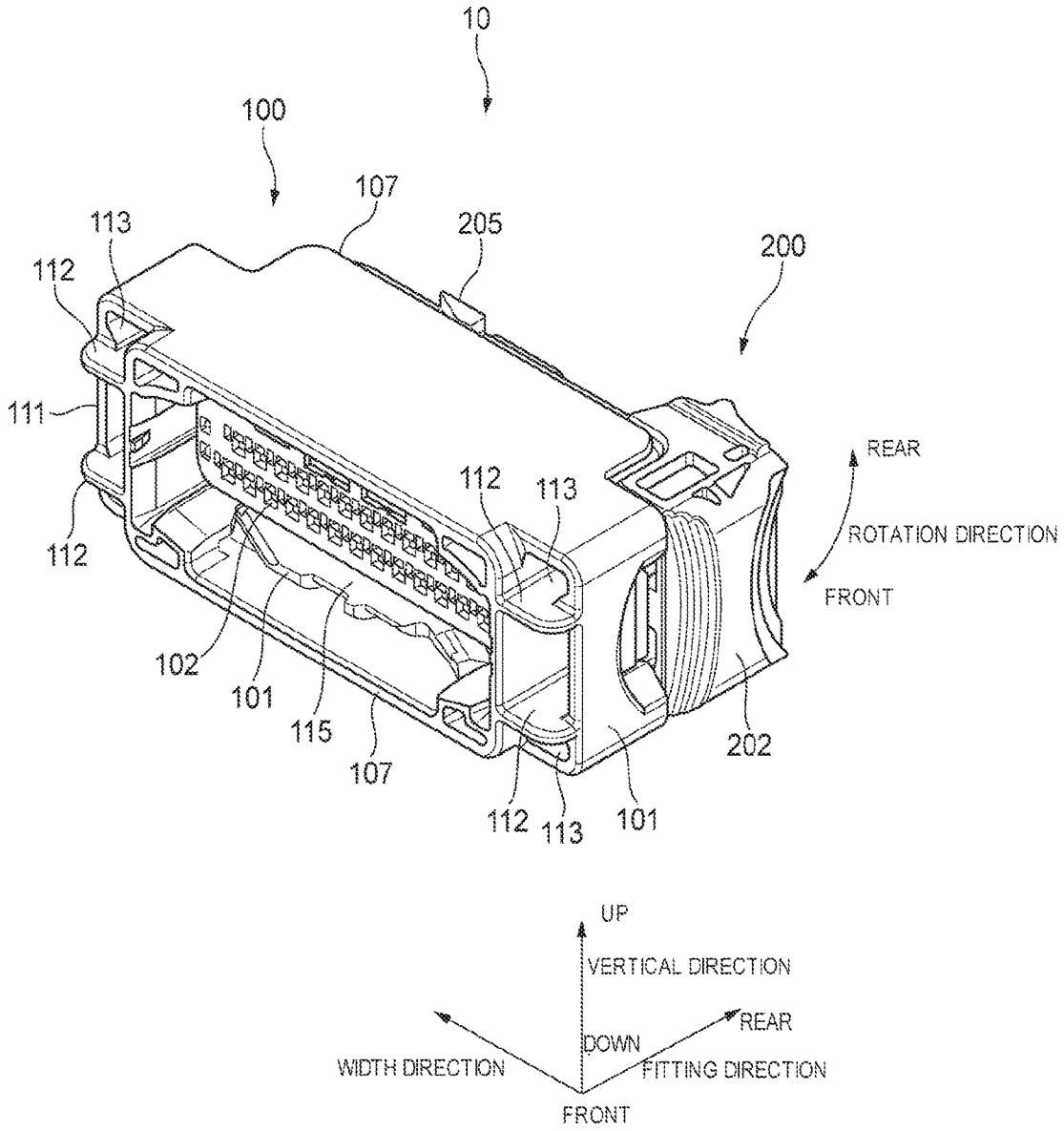
FIG. 1 is a perspective view of a lever type connector according to an embodiment of the invention when viewed from the front side.

As illustrated in FIG. 1, a lever type connector 10 according to an embodiment of the invention includes a female housing 100 which is fitted to a male housing such that the male housing (not illustrated) serving as a mating connector is stored (the male housing is inserted), and a lever 200 which is rotatably mounted in the female housing 100.

Hereinafter, "fitting direction", "width direction", "vertical direction", "front", "rear", "up", "down", and "rotation direction" of the lever 200 are defined as illustrated in FIG. 1. The "fitting direction", the "width direction", and the "vertical direction" are perpendicular to each other. "When the male housing and the female housing 100 are fitted" will be simply referred to as "at the time of fitting".

FIG. 1 illustrates a state where the lever 200 is at a final locking position. The lever 200 moves toward the final locking position by rotating forward in the rotation direction from a temporary locking position, and moves toward the temporary locking position by rotating backward in the rotation direction from the final locking position. The female housing 100 has a symmetric structure in which the lever 200 can be mounted in a reversible manner with respect to the width direction (so-called reversible structure). Hereinafter, the configurations of the female housing 100 and the lever 200 will be described sequentially.

Figure 2:
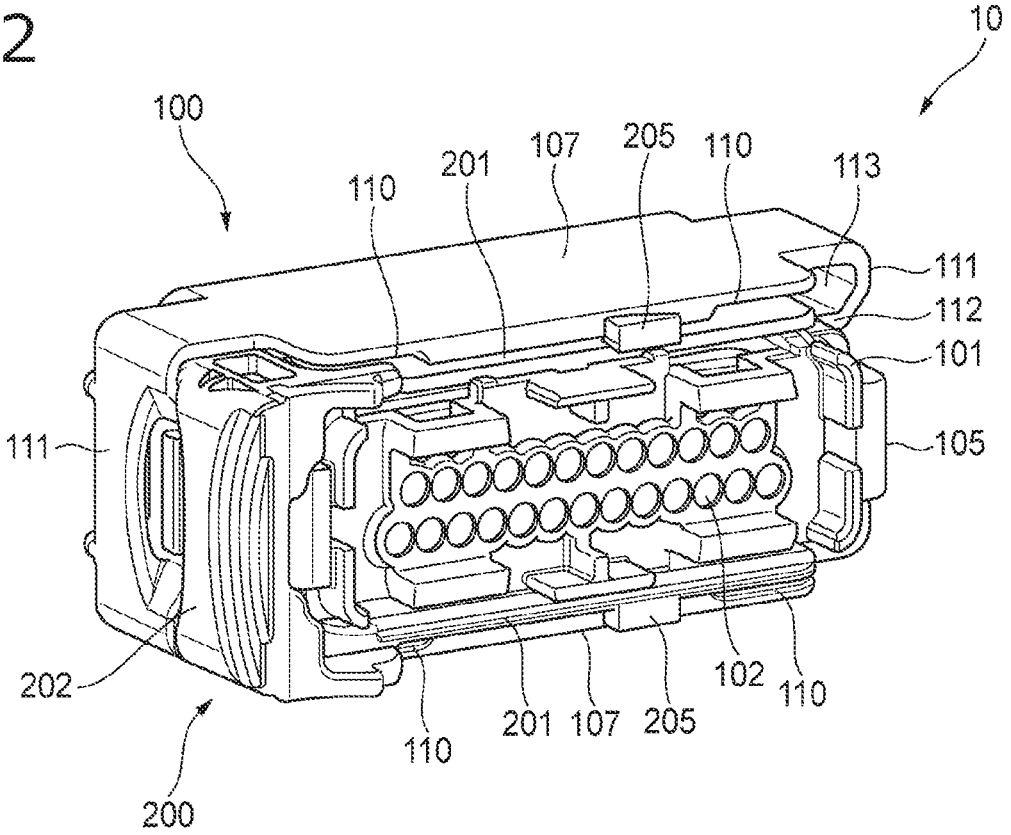
FIG. 2 is a perspective view of the lever type connector of FIG. 1 when viewed from the rear side.

First, the configuration of the female housing 100 will be described. As illustrated in FIGS. 1, 2, and 4, the female housing 100 is made of resin, and includes a main peripheral wall part 101 having a rectangular cylinder shape long in the width direction. At the time of fitting, the male housing and the female housing 100 are fitted such that an inner peripheral surface of the main peripheral wall part 101 and an outer peripheral surface of the male housing are overlapped and the male housing is stored in a fitting hollow 115 (see FIG. 1) which is an inner space of the main peripheral wall part 101. In the fitting hollow 115, a plurality of terminal housings 102 are formed along the fitting direction to store a plurality of female terminals (not illustrated) which are connected to the ends of wires (not illustrated).

As illustrated in FIGS. 6A to 8C, temporary locking ends 103 (four in total) serving as ends on the rear side of a sliding surface 104 in the fitting direction are disposed at positions close to the rear side from the center of the upper/lower surfaces of the main peripheral wall part 101 and at positions near both end portions in the width direction. The temporary locking end 103 is provided to lock the lever 200 at the temporary locking position (the details will be described below).

The sliding surfaces (flat surface) 104 (four in total) which are part of the upper/lower surfaces of the main peripheral wall part 101 are formed at positions adjacent to the temporary locking ends 103 on the front side of each temporary locking end 103 in the upper/lower surfaces of the main peripheral wall part 101. The sliding surface 104 is provided to bring a temporary locking arm 207 into press-contact while the lever 200 rotates (the details will be described below).

Figure 4A:
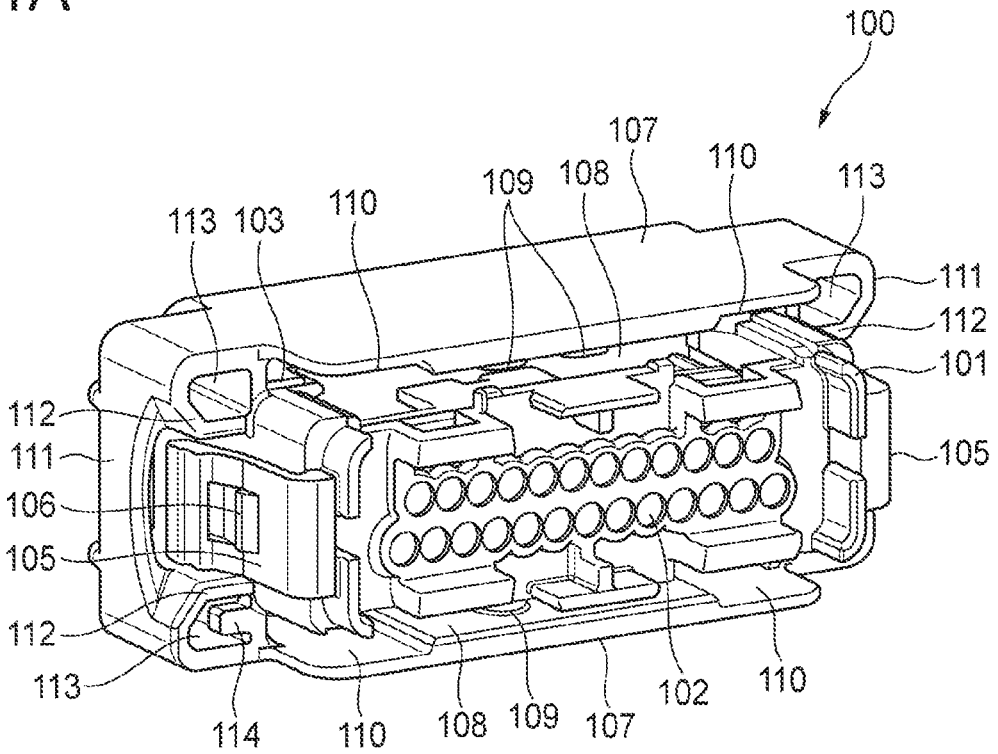
FIG. 4A is a perspective view of a female housing.
Figure 4B:
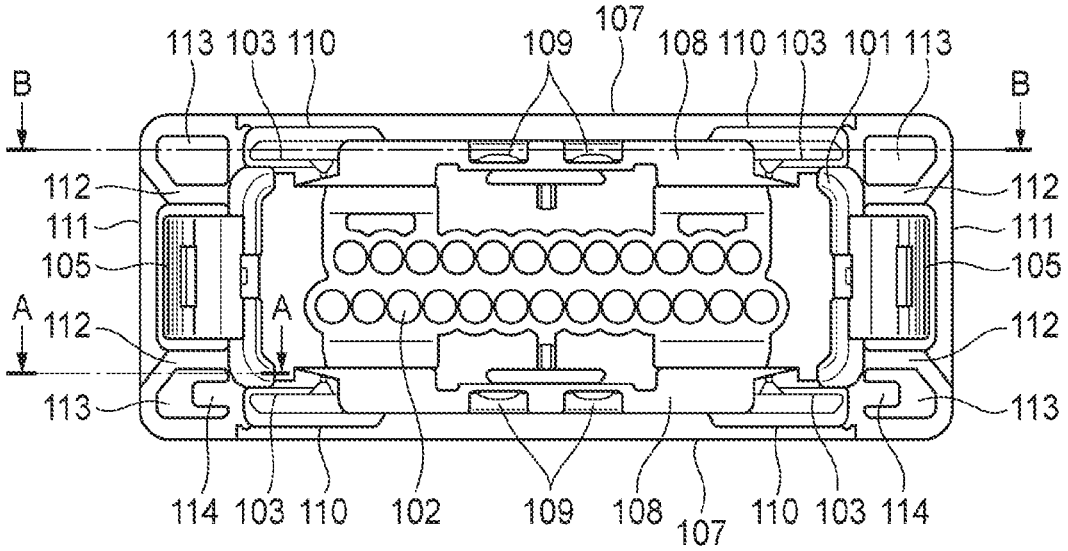
FIG. 4B is a rear view of the female housing.

As illustrated in FIGS. 4A and 4B, seat parts 105 are formed to protrude outward in the width direction at positions near the center in the vertical direction in both side surfaces of the main peripheral wall part 101 and at positions close to the rear side from the center in the fitting direction. A lock beak 106 is formed to protrude outward in the width direction in the top surface (the outer surface in the width direction) of each seat part 105. The lock beak 106 is provided to hold the lever 200 at the final locking position to the final locking position (the details will be described below).

In each of the upper/lower surfaces of the main peripheral wall part 101, a cover 107 is provided to extend in the width direction to cover the upper/lower surfaces of the main peripheral wall part 101 so as to link both ends in the width direction with a space 108 in the vertical direction. A pair of the spaces 108 positioned with a gap in the vertical direction stores the lever 200 at the final locking position to hide the lever 200.

As illustrated in FIGS. 4A, 4B, 6A to 8C, a pair of pivots 109 (four in total) are formed at the center in the width direction in an inner wall partition (the inner surface in the vertical direction) of each cover 107 to protrude to the inner side in the vertical direction in the space 108. Holes 203 and 204 (see also FIGS. 3A and 3B) of the lever 200 are fitted to the pair of pivots 109. With this configuration, the lever 200 is mounted to the female housing 100 to be rotatable about the pair of pivots 109 while being slightly translated.

As illustrated in FIGS. 4A and 4B, a depressed portion 110 is formed to be dented outward in the vertical direction at each position facing the temporary locking end 103 and the sliding surface 104 in the inner wall surface of each cover 107. The depressed portion 110 is provided to smoothly pass through the space 108 while the temporary locking arm 207 of the lever 200 (see FIGS. 3A and 3B) is not brought into contact with the inner wall partition of the cover 107 (the details will be described below).

Connection parts 111 are provided at positions in front of the seat parts 105 in both side surfaces of the main peripheral wall part 101 to extend in the vertical direction to cover both side surfaces of the main peripheral wall part 101 with a space in the width direction so as to link both ends in the vertical direction. Partitions 112 (four in total) are formed at positions slightly separated from both ends in the vertical direction of the connection part 111 to the inner side in the vertical direction to extend in the width direction so as to link the side surface of the main peripheral wall part 101 and the connection part 111. As a result, an identifying hollow (through hole) 113 is formed at each of four corners of the main peripheral wall part 101 to pass through in the fitting direction.

Identifying portions 114 are provided in two identifying hollows 113 on the lower side among four identifying hollows 113 to protrude outward in the width direction in the identifying hollow 113. The identifying portion 114 is provided in correspondence with each mounting direction of the lever 200, and is used to identify whether the mounting direction of the lever 200 is correct.

Figure 5:
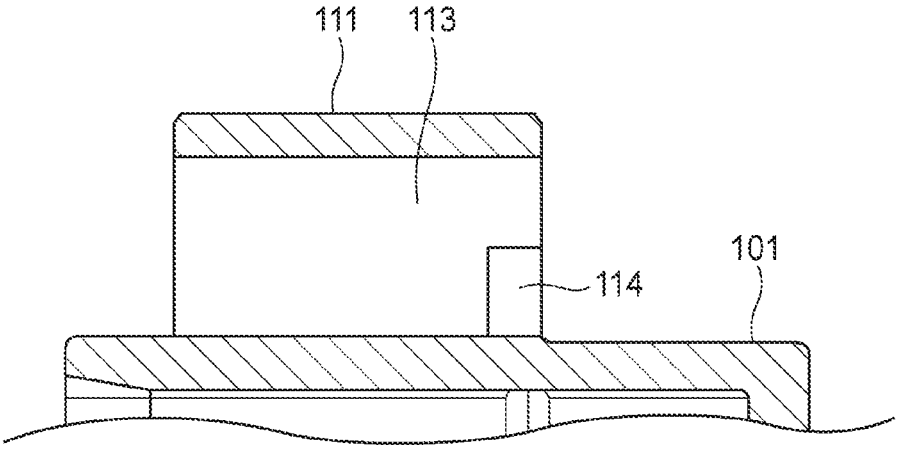
FIG. 5 is a cross-sectional view taken along line A-A of FIG. 4B.

As illustrated in FIG. 5, in this example, the identifying portion 114 is provided near each opening end on both sides in the fitting direction of the lower identifying hollow 113. With this configuration, the identifying portion 114 can be recognized optically and mechanically, and a correct mounting direction of the lever 200 can be identified without relying on human eyes.

Next, the configuration of the lever 200 will be described. As illustrated in FIGS. 1 to 3B, the lever 200 is made of resin, and is formed in an approximate U shape which includes a pair of side plates 201 and a link part 202 for connecting ends of the pair of side plates 201. The holes (through holes) 203 and 204 are formed in each of the pair of side plates 201. In addition, a projection 205 is formed in the end on the rear side in the rotation direction of the pair of side plates 201 to protrude to the outer side in the vertical direction.

As illustrated in FIGS. 6A to 8C, the pair of side plates 201 are inserted into the pair of spaces 108 of the housing 100, the pair of pivots 109 provided in the inner wall of the cover 107 are inserted into the holes 203 and 204, and the pair of projections 205 are kept in a state of contact with the rear end surface of the pair of covers 107. With this configuration, the lever 200 is rotatable about the pair of pivots 109 while being slightly translated with respect to the female housing 100 in a state where the pair of side plates 201 interpose the upper/lower surfaces of the main peripheral wall part 101 of the female housing 100.

Figure 3A:
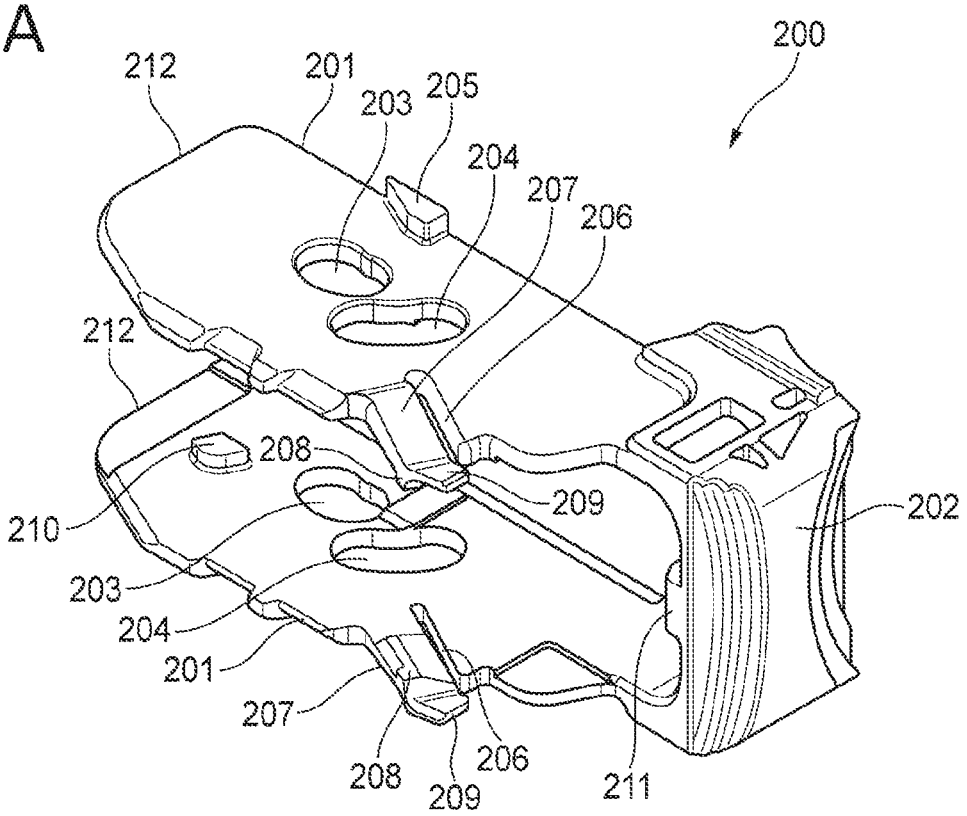
FIG. 3A is a perspective view of a lever.
Figure 3B:
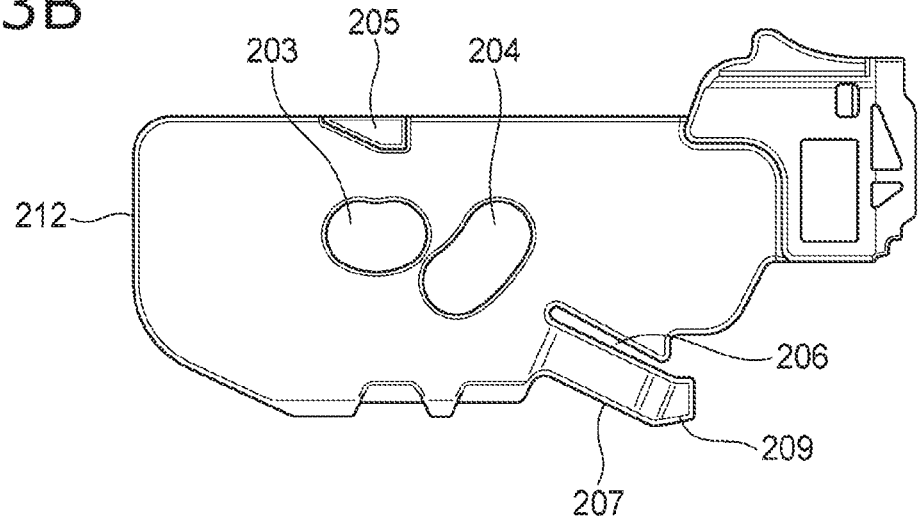
FIG. 3B is a top view of the lever.

As illustrated in FIGS. 3A and 3B, a notch 206 is formed in each end on the front side in the rotation direction of the pair of side plates 201. As a result, a pair of temporary locking arms 207 having a long cantilever beam shape are formed in the end on the front side in the rotation direction of the pair of side plates 201, and fixed to a portion near the deepest portion of the notch 206 so as to be adjacent to the pair of notches 206. In the inner side surface of each temporary locking arm 207 in the vertical direction, a projection 208 is formed to protrude to the inner side in the vertical direction over a predetermined range in an extending direction of the temporary locking arm 207 except a leading edge 209.

Figure 6A:
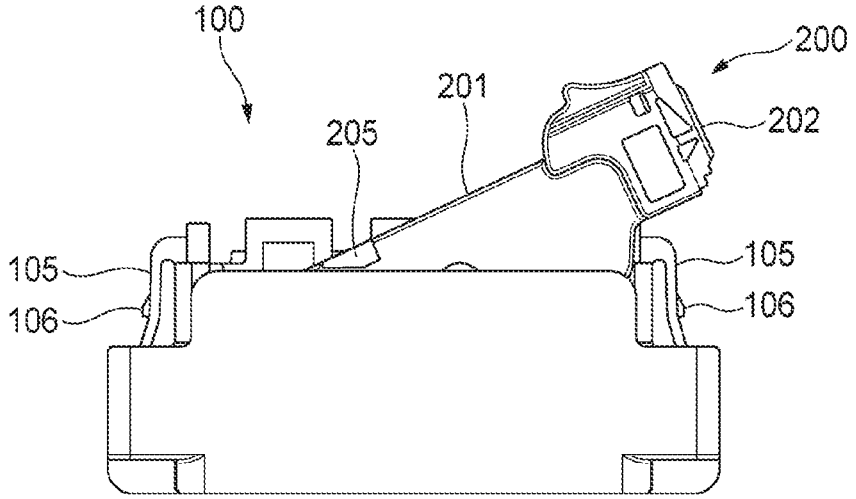
FIG. 6A is a top view in a case where the lever is at a temporary locking position.
Figure 6B:
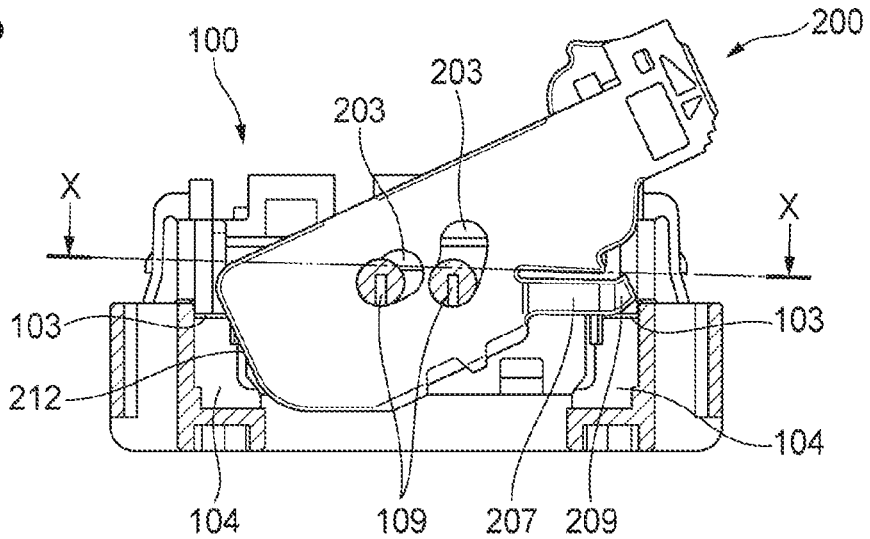
FIG. 6B is a cross-sectional view taken along line B-B of FIG. 4B.
Figure 6C:
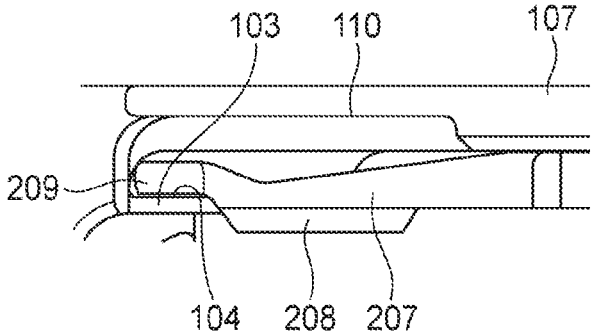
FIG. 6C is a cross-sectional view taken along line X-X of FIG. 6B.

As illustrated in FIGS. 6A to 6C, in a state where the lever 200 is at the temporary locking position, the leading edges 209 of the pair of temporary locking arms 207 are disposed to face the outer side in the width direction, and the side surfaces of the pair of temporary locking arms 207 (more specifically, the side surfaces of the projection 208) are engaged to the pair of temporary locking ends 103 corresponding to the female housing 100. When the temporary locking arm 207 is engaged to the temporary locking end 103, the lever 200 is engaged to the temporary locking position, and prevented from moving to the final locking position of the lever 200.

At the time of fitting, predetermined positions of the projections 208 of the pair of temporary locking arms 207 are pressed by predetermined pressing parts of the male housing, and thus the pair of temporary locking arms 207 are elastically deformed to the outer side in the vertical direction. As a result, the engagement of the temporary locking end 103 of the temporary locking arm 207 is released, and the lever 200 can move forward in the rotation direction from the temporary locking position toward the final locking position.

When the pair of temporary locking arms 207 are elastically deformed to the outer side in the vertical direction, the temporary locking arm 207 is first deformed due to the pair of notches 206, and all the side plate 201 (in particular, the surrounding of the holes 203 and 204) is hard to be elastically deformed to the outer side in the vertical direction. Therefore, the holes 203 and 204 are hard to be separated from the pair of pivots 109 compared to a case where the notch 206 is not provided. As a result, the separation between the lever 200 and the female housing 100 is hard to occur (the lever is not pulled out).

As illustrated in FIGS. 3A and 3B, cam bosses 210 are provided in the inner side surface near the other end 212 on the opposite side to the link part 202 in the pair of side plates 201, and protrude to the inner side in the vertical direction. At the time of fitting, a pair of cam bosses 210 are provided to engage a pair of cam grooves (not illustrated) of the male housing along the rotation from the temporary locking position of the lever 200 to the final locking position, and to draw the male housing (the details will be described below).

A lock part 211 is formed in a rear surface of the link part 202 (the inner surface in the width direction). The lock part 211 cooperates with the lock beak 106 of the female housing 100 (see FIGS. 4A and 6C), and is provided to hold the lever 200 from the final locking position to the locking position.

Hereinafter, the description will be simply given with reference to FIGS. 6A to 8C about an operation when the male housing (not illustrated) is drawn from the fitting-start state until the fitting-end state by rotating the lever 200 mounted in the female housing 100 from the temporary locking position to the final locking position.

First, as illustrated in FIGS. 6A to 6C, the female housing 100 of which the lever 200 is engaged at the temporary position and the male housing (not illustrated) are disposed such that the front surfaces face each other. As illustrated in FIGS. 6A to 6C, in the temporary locking position, the pair of pivots 109 are inserted into the holes 203 and 204 of the lever 200, and the pair of projections 205 are kept in a state of coming into contact with the rear end surface of the pair of covers 107. In addition, the pair of other ends 212 of the lever 200 are overlapped on a pair of sliding surfaces 104 corresponding to the pair of housings 100.

Figure 7A:
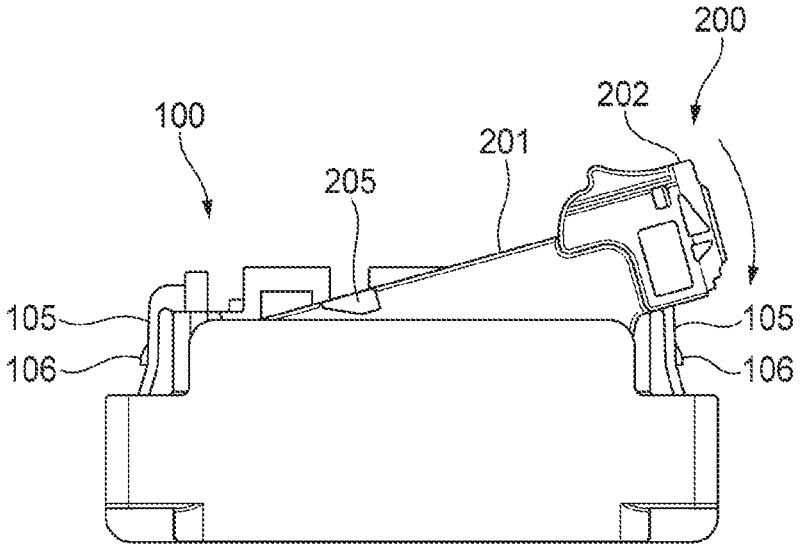
FIG. 7A is a top view in a case where a temporary locking arm of the lever goes over a temporary locking end.
Figure 7B:
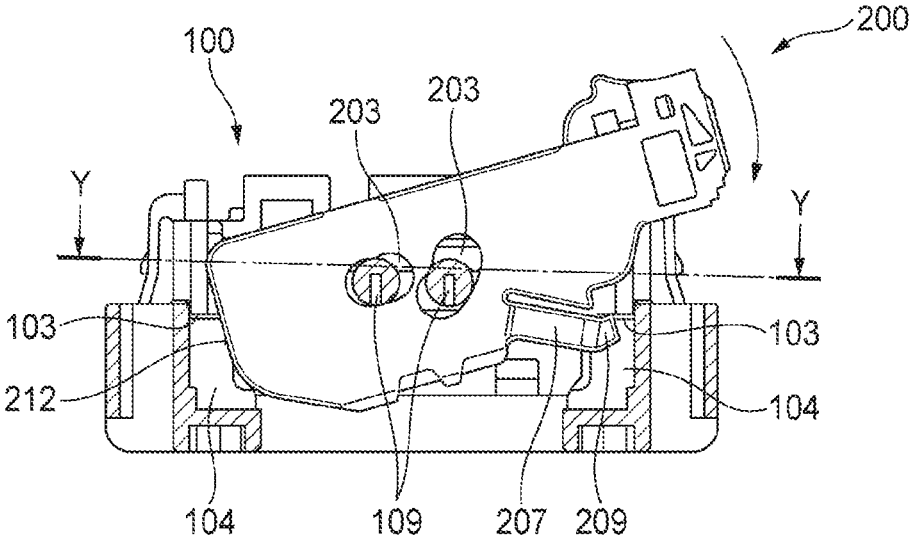
FIG. 7B is a cross-sectional view corresponding to the cross-sectional view taken along line B-B of FIG. 4B.
Figure 7C:
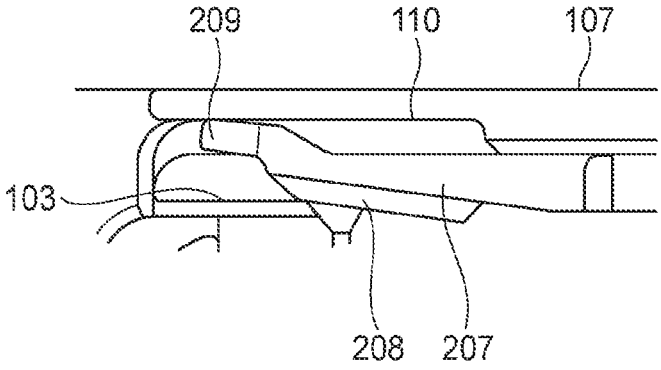
FIG. 7C is a cross-sectional view taken along line Y-Y of FIG. 7B, in which members near the front side from the temporary locking arm are omitted for the convenience of explanation.

Next, as illustrated in FIGS. 7A to 7C, the male housing is inserted to be the fitting-start state with respect to the female housing 100. In the fitting-start state, the predetermined positions of the projections 208 of the pair of temporary locking arms 207 are pressed by the predetermined pressing parts of the male housing, and the pair of temporary locking arms 207 are elastically deformed to the outer side in the vertical direction. Therefore, the lever 200 is movable from the temporary locking position to the final locking position. In the fitting-start state, the pair of cam bosses 210 of the lever 200 is positioned at an input part of the pair of cam grooves of the male housing.

The link part 202 of the lever 200 is pressed to the front side in the rotation direction while keeping a state where the pair of projections 205 are come into contact with the rear end surface of the pair of covers 107, and the lever 200 is moved (rotated) toward the final locking position from the temporary locking position from the fitting-start state. With this configuration, as illustrated in FIGS. 7A to 7C, the pair of temporary locking arms 207 (more specifically, the projection 208) go over the pair of temporary locking ends 103 of the housing 100. In this case, as illustrated in FIG. 7C, the pair of temporary locking arms 207 are elastically deformed to the outer side in the vertical direction. However, since the depressed portion 110 is formed in the inner wall partition of the cover 107, the pair of temporary locking arms 207 can smoothly pass through the space 108 without coming into contact with the inner wall partition of the cover 107.

After the pair of temporary locking arms 207 (the projection 208) go over the temporary locking end 103 of the housing 100, the leading edge 209 of the pair of temporary locking arms 207 comes into press-contact with the sliding surface 104 corresponding to the housing 100. Thereafter, the pair of other ends 212 of the lever 200 are overlapped with the corresponding pair of sliding surfaces 104 as the lever 200 keeps rotating. While the leading edge 209 of the pair of temporary locking arms 207 keeps coming into press-contact with the corresponding sliding surface 104, the male housing is drawn toward the rear side of the female housing 100 with the cooperation of the pair of cam bosses 210 of the lever 200 and the pair of cam grooves of the male housing.

Figure 8A:
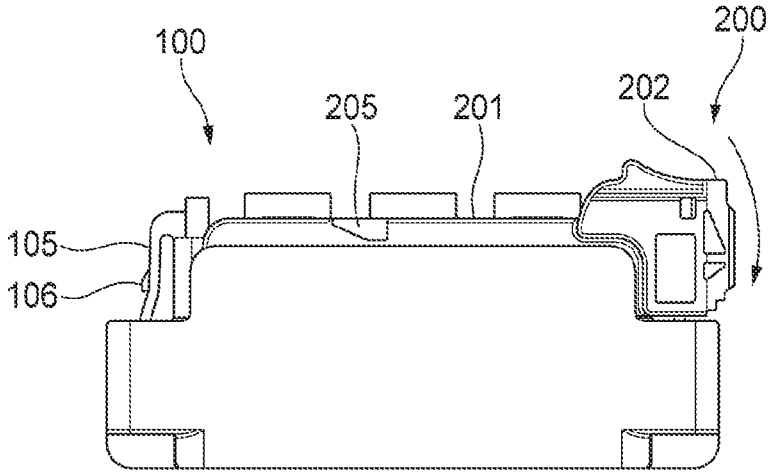
FIG. 8A is a top view in a case where the lever is at a final locking position.
Figure 8B:
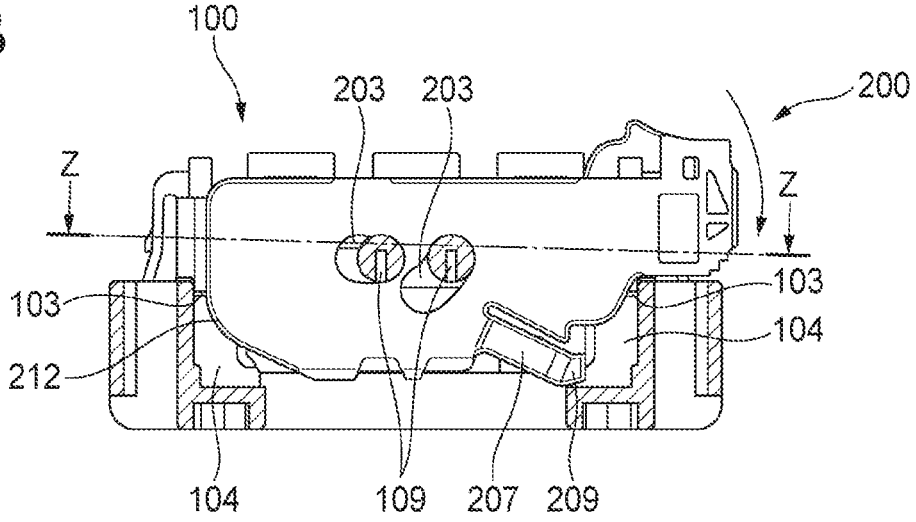
FIG. 8B is a cross-sectional view corresponding to the cross-sectional view taken along line B-B of FIG. 4B.
Figure 8C:
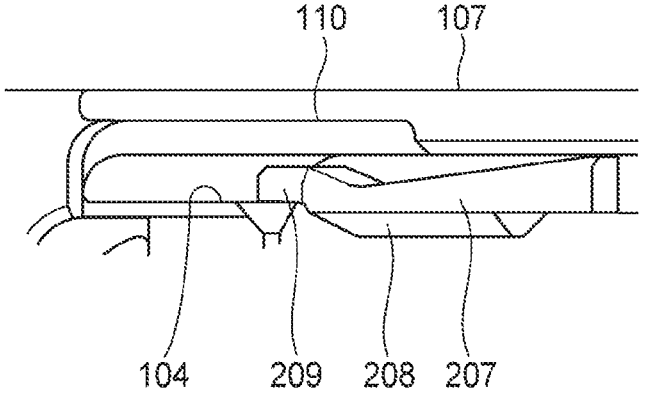
FIG. 8C is a cross-sectional view taken along line Z-Z of FIG. 8B, in which members near the front side from the temporary locking arm are omitted for the convenience of explanation.

Then, as illustrated in FIGS. 8A to 8C, when the lever 200 reaches the final locking position, the lock part 211 of the lever 200 (see FIG. 3A) is engaged with the lock beak 106 of the female housing 100 (see FIGS. 4A and 4B and 6A to 6C). With this configuration, a conductive connection between the male terminal (not illustrated) and the female terminal (not illustrated) provided in the male housing and the female housing 100 ends, and the lever 200 is held at the final locking position.

Hereinbefore, in the lever type connector 10 according to the embodiment of the invention, while the lever 200 rotates, the temporary locking arm 207 of the lever 200 comes into press-contact with the sliding surface 104 all the time, and the other end 212 of the lever 200 keeps overlapping with the other corresponding sliding surface 104. Therefore, if the pivot of the lever 200 is inclined, the pivot of the lever 200 returns to its original posture by the elastic forces of the temporary locking arm 207 of the lever 200 and the other end 212 of the lever 200, and as a result, the lever 200 can return to a state where the pivot is not inclined. In other words, the lever type connector 10 of this configuration can prevent the pivot of the lever 200 from being inclined.

Further, since the temporary locking arm 207 comes into press-contact with the corresponding sliding surface 104 all the time as described above, it is also possible to prevent the leading edge 209 of the temporary locking arm 207 from being pulled off from the sliding surface 104. Since the pull-off of the leading edge 209 can be prevented, it is possible to prevent that the pull-off leading edge 209 comes into contact with the edge of the sliding surface 104 and thus the rotation of the lever 200 is hindered.

Further, according to the lever type connector 10, the temporary locking arm 207 is covered with the cover 107 of the housing 100. Therefore, the rotation of the temporary locking arm 207 is not hindered by the peripheral members. Further, it is prevented contamination of foreign matter between the temporary locking arm 207 and the sliding surface 104. In addition, since the temporary locking arm 207 is covered with the cover 107, the outer appearance is also excellent.

Further, according to the lever type connector 10, the housing 100 has a symmetric structure in which the lever 200 can be mounted in a reversible manner with respect to the width direction (the housing 100 is reversible). Therefore, when the lever 200 is mounted in the housing 100, there is a possibility that the mounting direction of the lever 200 is erroneously reversed since the housing 100 is laterally symmetrical. With this regard, according to the lever type connector 10, the identifying portion 114 is provided in the identifying hollow 113 of the housing 100. Therefore, for example, it is possible to recognize optically and mechanically whether the identifying portion 114 is present, and to identify whether the mounting direction of the lever 200 is correct without relying on human eyes.

Further, since the identifying portion 114 is provided in the identifying hollow 113 which is a hollow different from the fitting hollow 115, the providing of the identifying portion 114 does not affect the fitting between the connectors. Furthermore, since the identifying portion 114 is provided in the identifying hollow 113, there is no problem that the identifying portion 114 comes into contact with a wire extending from the connector, and the outer appearance is also excellent. In addition, since there is no need to change the mold of the fitting hollow 115 in order to provide the identifying portion 114, it is possible to prevent an increase in a manufacturing cost.

OTHER EXAMPLES

Further, the invention is not limited to the above embodiments, and various modifications can be employed within the scope of the invention. For example, the invention is not limited to the above embodiments, and modifications and improvements can be appropriately made. Besides, materials, shapes, dimensions, numbers, and dispositions of the respective components in the above embodiments may be arbitrary and not limited as long as the invention can be achieved.

For example, in the above embodiments, while the lever 200 rotates, the temporary locking arm 207 of the lever 200 comes into press-contact with the corresponding sliding surface 104 all the time, and the other end 212 of the lever 200 keeps overlapping with the other corresponding sliding surface 104. However, while the lever 200 rotates, the temporary locking arm 207 of the lever 200 keeps the state of coming into press-contact with the corresponding sliding surface 104 all the time and, on the other hand, the other end 212 of the lever 200 may be not overlapped with the other corresponding sliding surface 104.

Further, in the above embodiment, the lever 200 is mounted in the female housing 100. However, the lever 200 may be mounted in the male housing. In addition, in the above embodiment, the notch 206 is provided between the side plate 201 and the temporary locking arm 207 of the lever 200, but such a notch may be not provided.

Further, in the above embodiment, two identifying hollow 113 positioned in the lower side among four identifying hollows 113 each are provided with the identifying portion 114. However, the identifying portion 114 may be provided in the other identifying hollows 113. In addition, in the above embodiment, the identifying portion 114 is provided near the opening ends on both sides in the fitting direction of the identifying hollow 113. However, the identifying portion 114 may be provided only near the opening end of one side in the fitting direction of the identifying hollow 113. Further, the identifying portion 114 may be not provided near the opening end in the fitting direction of the identifying hollow 113. In addition, the type of the female housing 100 (in correspondence with each mounding direction of the lever 200) may be identified according to a difference in the disposition of the identifying portion 114, and the type of the female housing 100 may be identified according to the presence/absence of the female housing 100 which includes the identifying portion 114.

In addition, in the above embodiment, the housing 100 has the symmetric structure in which the lever 200 can be mounted in a reversible manner with respect to the width direction (the housing 100 is reversible). However, the housing may not have the symmetric structure. In this case, there is no need to provide the identifying portion 114 in the identifying hollow 113.

Herein, the features of the embodiments of the lever type connector according to the invention will be simply summarized as the following (1) to (6).

(1) A lever type connector (10), including:

a housing (100) configured to fit to a mating connector; and a lever (200) mounted on the housing (100) and configured to draw the mating connector and the housing (100) to be close to each other when the lever (200) moves from a temporary locking position to a final locking position, wherein the lever (200) includes a temporary locking arm (207) which is elastically deformable in a direction away from a surface of the housing (100), and rotates between the temporary locking position and the final locking position in a state where the temporary locking arm (207) comes into press-contact with a sliding surface (104) which is a part of the surface of the housing.

(2) The lever type connector according to (1), wherein the housing (100) includes a cover (107) configured to cover the sliding surface (104); and wherein the cover (107) includes a depressed portion (110) in an inner wall surface facing the sliding surface (104) such that the temporary locking arm (207) is configured to pass through a space (108) between the sliding surface (104) and the cover (107).

(3) The lever type connector according to (1) or (2), wherein the housing (100) has a symmetric structure in which the lever (200) is mountable to the housing in a reversible manner with respect to a width direction of the housing;

wherein the housing includes an identifying hollow (113) which is opened to an outside and a fitting hollow (115) configured to receive the mating connector;

wherein an identifying portion (114) corresponding to each mounting direction of the lever (200) is provided in an inner portion of the identifying hollow; and wherein the identifying hollow (113) is different in position from the fitting hollow (115).

(4) The lever type connector according to (3), wherein the identifying portion (114) is provided near an opening end of the identifying hollow (113).

(5) The lever type connector according to (3) or (4), wherein the housing (100) includes a sliding surface (104) which corresponds to a first mounting direction of the lever (200), and a sliding surface (104) which corresponds to the second mounting direction of the lever, wherein the lever (200) is configured that when the lever (200) is mounted in the first mounting direction, the temporary locking arm (207) comes into press-contact with the sliding surface, and an edge (212) of the lever is positioned on the sliding surface; and wherein the lever (200) is configured that when the lever is mounted in the second mounting direction, the temporary locking arm (207) comes into press-contact with the sliding surface, and an edge (212) of the lever is positioned on the sliding surface.

(6) The lever type connector according to any one of (1) to (5), wherein the direction away from the surface of the housing (100) is substantially same as an axis direction of a rotation axis of the lever (200) rotating between the temporary locking position and the final locking position.

What is claimed is:

1. A lever type connector, comprising:

a housing configured to fit to a mating connector, wherein the housing comprises an interior space, the housing comprising at least one pivot; and a lever mounted on the housing and configured to draw the mating connector and the housing closer to each other when the lever moves from a temporary locking position to a final locking position, wherein the lever comprises:

a pair of side plates extending in parallel in a first direction and configured to be inserted into the interior space of the housing, the pair of side plates comprising at least one hole, each of which is fitted to a corresponding pivot of the at least one pivot, a link part extending in a second direction perpendicular to the first direction, the link part connecting ends of the pair of side plates to form a U shape, and a temporary locking arm extending from at least one of the pair of side plates, wherein the temporary locking arm is elastically deformable in a direction away from a surface within the interior space of the housing, and wherein the lever is further configured to rotate between the temporary locking position and the final locking position while the temporary locking arm maintains press-contact with a sliding surface which is a part of the surface within the interior space of the housing such that, when the at least one pivot is inclined relative to the lever, an elastic force of the temporary locking arm causes the at least one pivot to return to an uninclined position relative to the lever.

2. The lever type connector according to claim 1, wherein the housing further comprises a cover configured to cover the sliding surface; and wherein the cover comprises a depressed portion, which is dented outward, in an inner wall surface facing the sliding surface such that the temporary locking arm is configured to pass through a space between the sliding surface and the cover.

3. The lever type connector according to claim 1, wherein the sliding surface comprises a first sliding surface and a second sliding surface;

wherein the housing includes the first sliding surface which corresponds to a first mounting direction of the lever, and the second sliding surface which corresponds to a second mounting direction of the lever;

wherein the lever is configured that when the lever is mounted in the first mounting direction, the temporary locking arm maintains press-contact with the first sliding surface, and a first edge of the lever is positioned on the second sliding surface; and wherein the lever is configured that when the lever is mounted in the second mounting direction, the temporary locking arm maintains press-contact with the second sliding surface, and a second edge of the lever is positioned on the first sliding surface.

4. The lever type connector according to claim 1, wherein the direction away from the surface of the housing is substantially same as an axis direction of a rotation axis of the lever rotating between the temporary locking position and the final locking position.

5. The lever type connector according to claim 1, wherein a notch is formed in an end of the at least one of the pair of side plates; and wherein the notch is extended along a side end of the temporary locking arm.

6. The lever type connector according to claim 1, wherein the housing has a symmetric structure in which the lever is mountable to the housing in a reversible manner with respect to a width direction of the housing, wherein the housing comprises an identifying hollow which is opened to an outside and a fitting hollow configured to receive the mating connector, wherein the housing comprises an identifying portion, the identifying portion corresponding to each mounting direction of the lever being provided in an inner portion of the identifying hollow, and wherein the identifying hollow is at a different position than the fitting hollow.

7. The lever type connector according to claim 6, wherein the identifying portion is provided near an opening end of the identifying hollow.

* * * * *